US008313591B2

(12) United States Patent
Hirata et al.

(10) Patent No.: US 8,313,591 B2
(45) Date of Patent: Nov. 20, 2012

(54) AUSTENITIC HEAT RESISTANT ALLOY

(75) Inventors: Hiroyuki Hirata, Neyagawa (JP); Atsuro Iseda, Kobe (JP); Hirokazu Okada, Kobe (JP); Hiroyuki Semba, Sanda (JP); Kaori Kawano, Neyagawa (JP); Osamu Miyahara, Takarazuka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/647,028

(22) Filed: Dec. 24, 2009

(65) Prior Publication Data

US 2010/0166594 A1 Jul. 1, 2010

(30) Foreign Application Priority Data

Dec. 25, 2008 (JP) ..... 2008-329206

(51) Int. Cl.
*C22C 30/00* (2006.01)
*C22C 19/05* (2006.01)

(52) U.S. Cl. ..... 148/442; 148/427; 148/428; 420/442; 420/453; 420/454; 420/584.1; 420/585; 420/586; 420/586.1

(58) Field of Classification Search ..... 148/427, 148/428, 442; 420/442, 453, 454, 584.1, 420/585, 586, 586.1
See application file for complete search history.

(56) References Cited

U.S. PATENT DOCUMENTS

| | | | | |
|---|---|---|---|---|
| 5,021,215 | A * | 6/1991 | Sawaragi et al. | 420/584.1 |
| 5,543,109 | A * | 8/1996 | Senba et al. | 420/446 |
| 5,716,468 | A * | 2/1998 | Tanaka et al. | 148/649 |
| 6,447,716 | B1 * | 9/2002 | Cozar et al. | 420/445 |
| 6,623,869 | B1 | 9/2003 | Nishiyama et al. | |
| 6,926,778 | B2 * | 8/2005 | Iseda et al. | 148/327 |
| 2003/0005981 | A1 | 1/2003 | Ogawa et al. | |
| 2003/0198567 | A1 | 10/2003 | Iseda et al. | |

FOREIGN PATENT DOCUMENTS

| | | | |
|---|---|---|---|
| CN | 101151394 | | 3/2008 |
| CN | 101307402 | * | 11/2008 |
| JP | 51-84726 | | 7/1976 |
| JP | 51-84727 | | 7/1976 |
| JP | 54023016 A | * | 2/1979 |
| JP | 58045359 A | * | 3/1983 |
| JP | 59182919 A | * | 10/1984 |
| JP | 60-100640 | | 6/1985 |
| JP | 61-179833 | | 8/1986 |
| JP | 64-55352 | | 3/1989 |
| JP | 2-200756 | | 8/1990 |
| JP | 7-150277 | | 6/1995 |
| JP | 7-216511 | | 8/1995 |
| JP | 07-331390 | * | 12/1995 |
| JP | 7-331390 | | 12/1995 |
| JP | 8-127848 | | 5/1996 |
| JP | 8-218140 | | 8/1996 |
| JP | 08218140 | * | 8/1996 |
| JP | 9-157779 | | 6/1997 |
| JP | 2002-518599 | | 6/2002 |
| JP | 2004-003000 | | 1/2004 |
| JP | 2006176864 | * | 7/2006 |

OTHER PUBLICATIONS

R. Younger et al., "Heat-affected zone cracking in welded high-temperature austenitic steels", *Journal of the Iron and Steel Institute*, Oct. 1960, p. 188-193.

R. Younger et al., "Heat-Affected Zone Cracking in Welded Austenitic Steels During Heat Treatment", *British Welding Journal*, Dec. 1961, p. 579-587.

T. Naiki et al., "Cracking in Welded 18 Cr-12 Ni-Nb Steel during Stress Relieving", *Ishikawajima Harima Engineering Review*, vol. 15, No. 2, 1975, p. 209.

Welding and Joining Handbook, 2nd Edition, edited by the Japan Welding Society (2003, Maruzen), p. 948-953.

Davis, J.R. et al., "ASM Specialty Handbook, Nickel, Cobalt and Their Alloys", Dec. 1, 2000, XP002183407, Table 2.

* cited by examiner

*Primary Examiner* — Sikyin Ip
(74) *Attorney, Agent, or Firm* — Clark & Brody

(57) ABSTRACT

An austenitic heat resistant alloy, which contains, by mass percent, C≦0.15%, Si≦2%, Mn≦3%, Ni: 40 to 80%, Cr: 15 to 40%, W and Mo: 1 to 15% in total content, Ti≦3%, Al≦3%, N≦0.03%, O≦0.03%, with the balance being Fe and impurities, and among the impurities P≦0.04%, S≦0.03%, Sn≦0.1%, As≦0.01%, Zn≦0.01%, Pb≦0.01% and Sb≦0.01%, and satisfies the conditions [P1=S+{(P+Sn)/2}+{(As+Zn+Pb+Sb)/5}≦0.050], [0.2≦P2=Ti+2Al≦7.5−10×P1], [P2≦9.0−100×O] and [N≦0.002×P2+0.019] can prevent both the liquation crack in the HAZ and the brittle crack in the HAZ and also can prevent defects due to welding fabricability, which occur during welding fabrication, and moreover has excellent creep strength at high temperatures. Therefore, the alloy can be used suitably as a material for constructing high temperature machines and equipment, such as power generating boilers, plants for the chemical industry and so on. The ally may contain a specific amount or amounts of one or more elements selected from Co, B, Ta, Hf, Nb, Zr, Ca, Mg, Y, La, Ce and Nd.

2 Claims, No Drawings

AUSTENITIC HEAT RESISTANT ALLOY

TECHNICAL FIELD

The present invention relates to an austenitic heat resistant alloy. More particularly, it relates to an austenitic heat resistant alloy which has excellent weldability and is to be used in constructing high temperature machines and equipment, such as power generating boilers, plants for the chemical industry and so on.

BACKGROUND ART

In recent years, highly efficient Ultra Super Critical Boilers, with advanced steam temperature and pressure, have been built in the world. Specifically, it has been planned to increase steam temperature, which was about 600° C., to 650° C. or higher or further to 700° C. or higher. Energy saving, efficient use of resources and the reduction in the $CO_2$ gas emission for environmental protection are the objectives for solving energy problems, which are based on important industrial policies. And further, a highly efficient Ultra Super Critical Boiler and a reactor are advantageous for a power generating boiler and a reactor for the chemical industry, which burn fossil fuel.

High temperature and high pressure steam increases the temperature of a superheater tube for a boiler and a reactor tube for the chemical industry, and also high temperature machines and equipment constructed from thick plates, forgings and so on, which are used as heat resistant pressurized members, during a practical operation to 700° C. or higher. Therefore, not only the high temperature strength and high temperature corrosion resistance, but also the excellent stability of a microstructure for a long period of time and creep properties are required for the alloy used in such a severe environment.

Thus, the Patent Documents 1 to 3 disclose heat resistant alloys in which the contents of Cr and Ni are increased. Moreover, they additionally contain one or more of Mo and W, in order to improve the creep rupture strength which is a sort of high temperature strength.

Furthermore, from the viewpoint of increasingly demanding requirements for high temperature strength characteristics, especially the requirement for creep rupture strength, the Patent Documents 4 to 7 disclose heat resistant alloys which contain 28 to 38% of Cr and 35 to 60% of Ni by mass percent and exploit the precipitation of the α-Cr phase, which has a body-centered cubic structure and comprises mainly Cr, in order to ensure further improvement in creep rupture strength.

On the other hand, the Patent Documents 8 to 11 disclose Ni base alloys which are used in the above-described severe high temperature environment. These alloys contain Mo and/or W in order to achieve a solid solution strengthening effect, and contain Al and Ti in order to utilize the precipitation strengthening effect of the y' phase, which is an intermetallic compound, specifically, $Ni_3(Al, Ti)$.

Also, the Patent Document 12 proposes a high-Ni austenitic heat resistant alloy in which the addition range of Al and Ti is regulated and the Y' phase is precipitated in order to improve the creep strength.

Patent Document 1: JP 60-100640 A
Patent Document 2: JP 64-55352 A
Patent Document 3: JP 2-200756 A
Patent Document 4: JP 7-216511 A
Patent Document 5: JP 7-331390 A
Patent Document 6: JP 8-127848 A Patent Document 7: JP 8-218140 A
Patent Document 8: JP 51-84726 A
Patent Document 9: JP 51-84727 A
Patent Document 10: JP 7-150277 A
Patent Document 11: JP 2002-518599 A
Patent Document 12: JP 9-157779 A

DISCLOSURE OF THE INVENTION

Problems to be Solved by the Invention

In the above-mentioned Patent Documents 1 to 12, although the austenitic heat resistant alloys in which the creep rupture strength is improved have been disclosed, no study has been conducted from the viewpoint of "weldability" at the time when structural members made of such a material are assembled.

Parts made of austenitic heat resistant alloys are generally assembled into various structures by welding, and are used at high temperatures; the problem, which is reported, for example, in "Yo-setsu Setsugo Binran (Welding and Joining Handbook), 2nd edition, edited by the Japan Welding Society (2003, Maruzen)", pp. 948-950, is that if the content of alloying elements increases, cracks did occur in the welding heat affected zone (hereinafter referred to as "HAZ"), especially in a HAZ adjacent to a fusion boundary, at the time of welding fabrication.

Regarding the causes of the occurrence of the said cracks in the HAZ adjacent to a fusion boundary, various theories such as the grain boundary precipitated phase resulted-theory, the grain boundary segregation resulted-theory and so on have been proposed; the mechanism thereof, however, has not yet been identified.

In addition, even when the austenitic heat resistant alloy is used at a high temperature for a long period of time, there arises the problem that cracks occur in the HAZ. For example, R. N. Younger et al. have pointed out that intergranular cracks occur in the HAZ of welded portion of an 18Cr-8Ni type austenitic heat resistant steel due to the long-term heating in "Journal of the Iron and Steel Institute, October (1980), p. 188" and "British Welding Journal, December (1961), p. 579". In these literatures, the contribution of $M_{23}C_6$ and NbC carbides is suggested as a factor exerting an influence on the intergranular crack in the HAZ.

Furthermore, in the "Ishikawajima Harima Engineering Review, Vol. (1975), No. 2, p. 209", Naiki et al. studied preventive measures against the intergranular crack in the HAZ of the welded portion of an 18Cr-8Ni—Nb type austenitic heat resistant steel at the time of long-term heating. They have proposed measures from the viewpoint of a welding process in which the reductions in welding residual stress by an application of an appropriate post weld heat treatment are effective.

Thus, while the phenomenon of cracking in the HAZ at the time of welding fabrication or during a long-term of use has been known in austenitic heat resistant steels, the mechanisms thereof have not yet been elucidated and the art has no established measures, in particular from the material viewpoint, against such cracking.

In particular, a large number of austenitic heat resistant steels proposed recently, contain many kinds of alloying elements added thereto for attaining increases in strength and therefore show an increasing susceptibility toward such cracking in the welded portion.

On the other hand, in the case where the austenitic heat resistant steel is used as a welded structure, it is important to restrain not only the above-described weld cracking, which is a defect caused by material properties, but also a lack of fusion, a non-uniformity of bead and the like, which are defects caused by welding workability. As described above, the high strength austenitic heat resistant steels having been developed in recent years contain a large amount of alloying elements. Therefore, these steels are less compatible with weld metal, and defects caused by welding fabricability tend to occur.

Thus, the present invention was made in consideration of the above-mentioned circumstances. The objective of the present invention is to provide an austenitic heat resistant alloy which has excellent weldability and is used in constructing high temperature machines and equipment.

The phrase "excellent weldability" specifically indicates that the fabricability at the time of welding fabrication is high, and the cracks in a HAZ can be prevented at the time of welding fabrication and in a long-term of use at high temperatures.

Means for Solving the Problems

In order to solve the above-described problems, the present inventors carried out detailed investigations of the cracks which occurred in the HAZ at the time of welding fabrication and the cracks which occurred in the HAZ during the long-term of use. As a result, it was found that in order to prevent both of these kinds of cracks, it is most effective to restrict the contents of the grain boundary-embrittling elements within their respective specific ranges, and further it is also effective to control the contents of elements, which promote the precipitation of the fine intragranular phases, in their respective specific ranges.

More specifically, it was found that the problems can be solved by [1] restricting the contents of P, S, Sn, Sb, Pb, Zn and As within their respective specific ranges, and [2] optimizing the contents of Ti and Al.

On the other hand, the present inventors further carried out detailed investigations of the defects due to welding fabricability, which occur during welding fabrication. As a result, it was found that in order to prevent the occurrence of the said defects, that is to say defects caused by welding fabricability, it is effective to suppress the formation of weld slag. More specifically, it was found that 131 restricting the contents of Ti, Al and O within the respective specific ranges is effective.

The present inventors specifically clarified the following items <1> to <3> as the result of detailed investigations of the cracks which occurred in the HAZ during welding fabrication.

<1> Cracks occur at the grain boundaries which are adjacent to fusion boundaries.

<2> On the fractured surface of the crack, which occurred at the grain boundary adjacent to the fusion boundary during welding fabrication, a fusion trace was observed. P and S, and also Al and Ti were found concentrated on the fractured surface.

<3> The formation of intragranular phases, which contain Ti and Al, in the microstructure in the vicinity of the cracks was less than that in the microstructure in the base metal.

On the other hand, the present inventors specifically clarified the following items <4> to <6>, as the result of detailed investigations of the cracks which occurred in the welded portion used at high temperatures for a long period of time.

<4> Cracks occur at grain boundaries of the so-called "coarse-grained HAZ" exposed to high temperatures by welding.

<5> The fractured surface of the cracks are poor in ductility, and also the grain boundary-embrittling elements such as P, S and Sn are found concentrated on the fractured surface.

<6> In the microstructure in the vicinity of the cracks, a large amount of very fine intragranular phases, which contain Ti and Al, have precipitated.

From the above-described items, the present inventors came to the conclusion that the crack occurred during welding fabrication at the grain boundary, which is adjacent to the fusion boundary, is a liquation crack due to the following phenomena (1) to (4); (1) P and S segregate at grain boundaries due to the weld thermal cycles. (2) The intragranular phases containing Ti and Al, which were formed in the vicinity of the grain boundaries at the process of manufacturing a base metal, dissolve into the matrix due to the weld thermal cycles, and thereafter Ti and Al, which are main components of the said intragranular phases, segregate at the grain boundaries. (3) A drop in melting point of the grain boundary due to the said segregation of P, S, Ti and Al causes a localized fusion. (4) The localized fused portion is opened by the welding thermal stress. Therefore, hereinafter, the crack which occurred during welding fabrication at the grain boundary, which is adjacent to the fusion boundary, is referred to as a "liquation crack in the HAZ".

On the other hand, the present inventors came to the conclusion that the crack occurred during the use at high temperatures at the grain boundary of the said coarse-grained HAZ is a result of the opening of grain boundaries, which have been weakened due to not only the segregation of P and S at the grain boundaries during weld thermal cycles, but also the segregation of impurity elements such as Sn and Pb at the grain boundaries during the subsequent use, due to their undergoing external stress. Further, the present inventors came to the conclusion that in the case where fine intragranular phases containing a large amount of Ti and Al precipitate, the intragranular deformation is hindered, and therefore stress concentration occurs at the interface of the grain boundaries. And consequently, cracks tend to occur readily because of the superimposed effects of the said stress concentration on the interface of the grain boundaries and the embrittlement of the grain boundaries. Therefore, hereinafter, the crack which occurred during the use at high temperatures at grain boundary of the said coarse-grained HAZ is referred to as a "brittle crack in the HAZ".

As a mode of crack, similar to the above-mentioned brittle crack in the HAZ, there may be mentioned such as the SR crack in low alloy steels, as mentioned by Ito et al. in the "Journal of the JWS, Vol. 41 (1972), No. 1, p. 59". However, this SR crack in those low alloy steels is a crack occurring in the step of a short period SR heat treatment after welding, which is quite different in timing from the brittle crack in the HAZ which is the target of the present invention. In addition, the base metal (and the HAZ) has a ferritic microstructure and the mechanisms of occurrence of the SR crack therein are quite different from those in the austenitic microstructure, which is the target of the present invention. Therefore, as a matter of course, the measures for preventing the above-mentioned SR crack in low alloy steels as such, cannot be applied as a measure for preventing the brittle crack in the HAZ.

In the aforementioned literature of "Ishikawajima Harima Engineering Review, Vol. 15 (1975), No. 2, p. 209", Naiki et al. considered that the differences in strength between grains strengthened by Nb(C, N) and grain boundaries are factors which cause of intergranular cracks in the HAZ at the time of long-term heating, however there is no mention of factors causing intergranular embrittlement. Therefore, the technique disclosed by Naiki et al. suggests nothing about measures, from the material viewpoint, for preventing the brittle crack in the HAZ in the austenitic heat resistant alloy, which is the target of the present invention.

Accordingly, the present inventors carried out more detailed investigations of various kinds of austenitic heat resistant alloys, in order to prevent both of the "liquation crack in the HAZ" and the "brittle crack in the HAZ" and in order to secure the creep strength at high temperatures. As a result, the following important items <7> to <13> were clarified.

<7> In order to prevent both of the liquation crack in the HAZ and the brittle crack in the HAZ, it is effective to restrict the contents of P, S, Sn, As, Zn, Pb and Sb in the alloy, within respective ranges which satisfy a specific formula.

<8> The reason why the said two kinds of cracks can be prevented by restricting the contents of the elements described in the above item <7> is that the grain boundary segregation of these elements during the weld thermal cycle and/or during the subsequent use at high temperatures is reduced, so that the localized fusion at grain boundary in the weld thermal cycle process can be inhibited, and weakening the intergranular binding force during the subsequent long-term of use can be reduced.

<9> In particular, cracks are concerned in the austenitic heat resistant alloys containing by mass percent, Cr: 15 to 40% and Ni: 40 to 80%, S exerts the most malign influence. Next to S, P and Sn exert a malign influence, and in the third place, As, Zn, Pb and Sb exert a malign influence. And, in order to prevent the above-mentioned cracks, it becomes essential that the value of the parameter P1, defined by the formula (1) below, is derived by taking into consideration the weight of the influences of the respective elements should be not more than 0.050. In the formula, each element symbol represents the content by mass percent of the element concerned:

$$P1=S+\{(P+Sn)/2\}+\{(As+Zn+Pb+Sb)/5\} \quad (1).$$

<10> In order to prevent both of the said two cracks, first, it is effective to inhibit the formation of the intragranular phases containing Ti and Al, which were formed at the stage of base metal. Second, at the time of welding fabrication, it is effective to reduce the drop of the melting point of the grain boundary due to the segregation of Ti and Al at the grain boundaries; the said segregation of Ti and Al has occurred due to the dissolution of the said intragranular phases containing Ti and Al into the matrix by the weld thermal cycles. Third, during the long-term of use, it is effective to avoid the precipitation of fine intragranular phases which contain an excessive amount of Ti and Al and thereby inhibit the stress concentration at the interface of grain boundaries due to excessive intragranular strengthening.

<11> According to the contents of the above-mentioned impurity elements, from S to Sb, when the contents of Ti and Al are adjusted within appropriate ranges, it becomes possible to reduce the susceptibilities toward the said two kinds of cracks, and moreover to ensure the required levels of creep strength.

<12> In particular, in the austenitic heat resistant alloys containing by mass percent, Ni: 40 to 80%, from the viewpoint of the ensuring the required levels of creep strength, it becomes essential that the value of the parameter P2, defined by the formula (2) below, should be not less than 0.2; and on the other hand, from the viewpoint of the reduction in susceptibilities to the said two kinds of cracks, in relation to the aforementioned parameter P1, it becomes essential that the value of the parameter P2 should be not more than (7.5−10×P1 ). In the formula, each element symbol represents the content by mass percent of the element concerned:

$$P2=Ti+2Al \quad (2).$$

<13> N (nitrogen) is an element effective in stabilizing the austenitic phase. However, because of high affinity thereof with Al and Ti, N forms nitrides easily which reduces the amounts of Al and Ti necessary to form an intermetallic compound phase which contributes to the improvement in creep strength; and therefore, it is difficult to ensure creep strength at high temperatures. In order to get around this phenomenon, in relation to the contents of Al and Ti, it becomes essential that the upper limit of the N content should be (0.002×P2+0.019).

On the other hand, the present inventors carried out detailed investigations of the defects due to welding fabricability, which occur during welding fabrication. As a result, the following items <14> to <16> are specifically clarified.

<14> When subsequent welding fabrication is carried out on a weld bead which has a large amount of weld slag on the surface, a non-uniformity of bead and a lack of fusion are liable to occur.

<15> The above-described defects tend to occur easily in the vicinity of the root pass in which the dilution of the base metals is high.

<16> In the slag formed on the weld bead surface, remarkable concentrations of Al, Ti and O were observed.

From the above-mentioned items, it was conjectured that the defects due to welding fabricability such as a non-uniformity of bead, a lack of fusion and the like, may have been caused by the following facts (1) and (2). (1) When subsequent welding fabrication was carried out on the weld slag formed on the weld bead, the weld metal was difficult to spread on the slag. (2) Further the weld slag may be difficult to fuse at the time of subsequent welding fabrication, since the said slag is an oxide which has a high melting point. Therefore, the present inventors came to conclusion that in the vicinity of the root pass in which the dilution of the base metals is high and a large amount of Al, Ti and O are easily mixed in the weld metal; the weld slag is easily formed.

Thereupon, the present inventors carried out more detailed investigations of various kinds of austenitic heat resistant alloys in order to prevent the occurrence of the defects due to welding fabricability. As a result, the following important item <17> was clarified.

<17> In the case where the dilution of the base metals is extremely high, specifically, even in the case where the weld metal have completely the same composition as that of the base metal, in relation to the content of O, if the upper limit of the value of the parameter P2 expressed by the said formula (2) is set to not more than (9.0−100×O), the formation of weld slag is inhibited, and thereby the occurrence of the defects due to welding fabricability can be prevented.

The present invention has been accomplished on the basis of the above-described findings. The main points of the present invention are the austenitic heat resistant alloys shown in the following (1) to (3).

(1) An austenitic heat resistant alloy, which comprises, by mass percent, C: not more than 0.15%, Si: not more than 2%, Mn: not more than 3%, Ni: 40 to 80%, Cr: 15 to 40%, W and Mo: 1 to 15% in total content, Ti: not more than 3%, Al: not more than 3%, N: not more than 0.03% and O: not more than 0.03%, with the balance being Fe and impurities, in which the contents of P, S, Sn As, Zn, Pb and Sb among the impurities are P: not more than 0.04%, S: not more than 0.03%, Sn: not more than 0.1%, As: not more than 0.01%, Zn: not more than 0.01%, Pb: not more than 0.01% and Sb: not more than 0.01%, and the value of P1 defined by the following formula (1) and the value of P2 defined by the following formula (2) satisfy the relationships expressed by the following formulas (3) to (6);

$$P1=S+\{(P+Sn)/2\}+\{(As+Zn+Pb+Sb)/5\} \quad (1),$$

$$P2=Ti+2Al \quad (2),$$

$$P1\leqq 0.050 \quad (3),$$

$$0.2\leqq P2\leqq 7.5-10\times P1 \quad (4),$$

$$P2\leqq 9.0-100\times O \quad (5),$$

$$N\leqq 0.002\times P2+0.019 \quad (6);$$

wherein each element symbol in the formulas represents the content by mass percent of the element concerned.

(2) The austenitic heat resistant alloy according to the above (1), which contains, by mass percent, Co: not more than 20% in lieu of a part of Fe.

(3) The austenitic heat resistant alloy according to the above (1) or (2), which contains, by mass percent, one or more elements of one or more groups selected from the first to third groups listed below in lieu of a part of Fe:

First group: B: not more than 0.01%;

Second group: Ta: not more than 0.1%, Hf: not more than 0.1%, Nb: not more than 0.1% and Zr: not more than 0.2%; and Third group: Ca: not more than 0.02%, Mg: not more than 0.02%, Y: not more than 0.1%, La: not more than 0.1%, Ce: not more than 0.1% and Nd: not more than 0.1%.

The term "impurities" in "Fe and impurities" as the balance means substances that are mixed in by various factors of the manufacturing process when the heat resistant alloy is manufactured in an industrial manner, including a raw material such as ore, scrap and so on.

Effect of the Invention

The austenitic heat resistant alloys of the present invention can prevent both the liquation crack in the HAZ and the brittle crack in the HAZ and also can prevent defects due to welding fabricability, which occur during welding fabrication. Moreover, they have excellent creep strength at high temperatures. Therefore, the austenitic heat resistant alloys of the present invention can be used suitably as materials for constructing high temperature machines and equipment, such as power generating boilers, plants for the chemical industry and so on.

BEST MODES FOR CARRYING OUT THE INVENTION

In the following, the reasons for restricting the contents of the component elements of the austenitic heat resistant alloys in the present invention are explained in detail. In the following explanation, the symbol "%" for the content of each element means "% by mass".

C: not more than 0.15%

C (carbon) stabilizes the austenitic microstructure and forms carbides on the grain boundaries and thereby it improves the creep strength at high temperatures. However, if C is added excessively and the content thereof increases, in particular if it exceeds 0.15%, a large amount of carbides precipitate on the grain boundaries during the use at high temperatures. Thereby this causes a decrease in the ductility of the grain boundaries and also a deterioration of the creep strength. Moreover the susceptibility to the brittle crack in the HAZ during the long-term of use increases. Therefore, the content of C is set to not more than 0.15%. The upper limit of the C content is preferably 0.12%.

As described later, in the case where N is contained in a range sufficient for strengthening, it is not necessary to particularly specify any lower limit in the C content; however, an extreme reduction of the C content leads to a remarkable increase in production cost. Therefore, the lower limit of the C content is preferably 0.01%.

Si: not more than 2%

Si (silicon) is an element that is added as a deoxidizes, and it is effective in improving the corrosion resistance and oxidation resistance at high temperatures. However, if the content of Si increases and exceeds 2%, Si deteriorates the stability of the austenitic phase; thus creep strength and toughness deteriorate. Therefore, the content of Si is set to not more than 2%. The content of Si is preferably not more than 1.5% and more preferably not more than 1.0%. It is not necessary to particularly specify any lower limit in the Si content; however, an extreme reduction of the Si content results in failure to attain a sufficient deoxidizing effect, hence in the deterioration in cleanliness of the alloy and, in addition, in an increased production cost. Therefore, the lower limit of the Si content is preferably 0.02%.

Mn: not more than 3%

Like Si, Mn (manganese) is an element that is added as a deoxidizer. Mn also contributes to the stabilization of austenite. However, if Mn is added excessively and the content thereof increases, in particular if it exceeds 3%, Mn causes embrittlement and thus the creep ductility and toughness deteriorate. Therefore, the content of Mn is set to not more than 3%. The content of Mn is preferably not more than 2.5% and more preferably not more than 2.0%. It is also not necessary to particularly specify any lower limit in the Mn content; however, an extreme reduction of the Mn content results in failure to attain a sufficient deoxidizing effect, hence in the deterioration in cleanliness of the alloy and, in addition, in an increased production cost. Therefore, the lower limit of the Mn content is preferably 0.02%.

Ni: 40 to 80%

Ni (nickel) is an effective element for obtaining the austenitic microstructure and also is an essential element for ensuring the structure stability during a long-term of use thus improving the creep strength. In order to sufficiently achieve the aforementioned effects of Ni within the Cr content range of 15 to 40% of the present invention, it is necessary that the Ni content be not less than 40%. On the other hand, the addition of Ni, which is an expensive element, at a content level exceeding 80% results in an increase in cost. Therefore, the content of Ni is set to 40 to 80%. The lower limit of the Ni content is preferably 42% and the upper limit thereof is preferably 75%.

When it is desired to ensure a high creep rupture strength by utilizing the precipitation of α-Cr phase, the content of Ni is preferably 40 to 60%. The reason for this is that if the Ni content increases, the α-Cr phase does not precipitate in a stable condition. In the above-described case, the lower limit of the Ni content is preferably 42% and the upper limit thereof is preferably 55%.

Cr: 15 to 40%

Cr (chromium) is an essential element for ensuring the oxidation resistance and corrosion resistance at high temperatures. In order to achieve the aforementioned effects of Cr within the Ni content range of 40 to 80% of the present invention, it is necessary that the Cr content be not less than 15%. However, when the content of Cr is excessive, in particular at a content level exceeding 40%, it deteriorates the stability of austenitic phase at high temperatures and thus causes a deterioration of the creep strength. Therefore, the content of Cr is set to 15 to 40%. The preferable lower limit of the Cr content is 17% and the preferable upper limit thereof is 38%.

W and Mo: 1 to 15% in total content

Both W (tungsten) and Mo (molybdenum) are elements that dissolve into the austenitic phase, which is a matrix, and thereby they contribute to the improvement in the creep strength at high temperatures. In order to ensure this effect, it is necessary to contain W and Mo of not less than 1% in total content. However, when the total content of W and Mo increases, in particular exceeds 15%, the stability of austenitic phase deteriorates inversely and thus causes a deterioration of the creep strength. Moreover, the susceptibility to the brittle crack in the HAZ during the long-term of use increases. Therefore, the contents of W and Mo are set to 1 to 15% in total content. The lower limit of the total content of W and Mo is preferably 2% and more preferably 3%. Also, the upper limit of the total content of W and Mo is preferably 12% and more preferably 10%.

Incidentally, compared with Mo, W has the following features:

(a) The zero ductility temperature is higher, and therefore, particular at the so-called "high temperature side" of about not less than 1150° C., the excellent hot workability can be ensured, and (b) The amount dissolved into the fine intermetallic compound phase, which contributes to strengthening, is large. Therefore, W inhibits the fine intermetallic compound phase, which contributes to strengthening during the long-term of use, from coarsening; and thus, the stable and high creep rupture strength can be ensured on the side of high temperature over a long period of time.

Accordingly, in the case where it is desired to obtain more excellent hot workability and/or more excellent creep rupture strength, it is preferable that W be mainly contained. The content of W in this case is preferably not less than 3% and more preferably not less than 4%.

W and Mo need not be compositely contained, and only either one of these elements may be contained within the range of 1 to 15%.

Ti: not more than 3%

Ti (titanium) is an important element which forms the basis of the present invention together with Al. That is to say, Ti is an essential element for forming a fine intragranular intermetallic compound together with Ni and thus ensuring the creep strength at high temperatures. However, when the content of Ti is excessive, in particular at a content level exceeding 3%, the said intermetallic compound phase coarsens rapidly during the use at high temperatures and thus causes an extreme deterioration in the creep strength and toughness. In addition, at the stage of producing the alloy, the deterioration of the cleanliness of alloy occurs and thus the productivity deteriorates. Therefore, the content of Ti is set to not more than 3%.

Al: not more than 3%

Al (aluminum) is an important element which forms the basis of the present invention together with Ti. That is to say, Al is an essential element for forming the fine intragranular intermetallic compound together with Ni and thus ensuring the creep strength at high temperatures. However, when the content of Al is excessive, in particular at a content level exceeding 3%, the said intermetallic compound phase coarsens rapidly during the use at high temperatures and thus causes an extreme deterioration in the creep strength and toughness. Moreover, at the stage of producing the alloy, the deterioration of the cleanliness of the alloy occurs and thus the productivity deteriorates. Therefore, the content of Al is set to not more than 3%.

N: not more than 0.03%

N (nitrogen) is an effective element for stabilizing the austenitic phase. However, when the content of N is excessive, in particular at a content level exceeding 0.03%, N forms nitrides of Cr in addition to the nitrides of Ti and Al; thus creep strength and/or toughness are deteriorated. Therefore, the content of N is set to not less than 0.03%. It is not necessary to particularly specify any lower limit in the N content; however, an extreme reduction of the N content results in an increased production cost. Therefore, the lower limit of the N content is preferably 0.0005%.

O: not more than 0.03%

O (oxygen) is an element contained in the alloy as one of the impurity elements. If the content of 0 increases and exceeds 0.03%, the hot workability is deteriorated; and moreover the toughness and ductility are also deteriorated. Therefore, the content of 0 is set to not more than 0.03%. It is not necessary to particularly specify any lower limit in the 0 content; however, an extreme reduction of the 0 content results in an increased production cost. Therefore, the lower limit of the 0 content is preferably 0.001%.

P: not more than 0.04%, S: not more than 0.03%, Sn: not more than 0.1%, As: not more than 0.01%, Zn: not more than 0.01%, Pb: not more than 0.01% and Sb: not more than 0.01%

In the present invention, it is necessary to restrict the contents of P, S, Sn, As, Zn, Pb and Sb among the impurities to the specific range.

That is to say, all of the above-mentioned elements segregate at the grain boundaries due to the welding thermal cycle at the time of welding fabrication or due to the long-term of use at high temperatures; thus during welding fabrication, the melting point of grain boundary falls and causes an increase in the susceptibility to the liquation crack in the HAZ. During the use at high temperatures, the intergranular binding force decreases and causes the brittle crack in the HAZ. Therefore, regarding P, S, Sn, As, Zn, Pb and Sb, first it is necessary to restrict the contents thereof as follows; P: not more than 0.04%, S: not more than 0.03%, Sn: not more than 0.1%, As: not more than 0.01%, Zn: not more than 0.01%, Pb: not more than 0.01% and Sb: not more than 0.01%.

In the case of the austenitic heat resistant alloys of the present invention which contains Cr: 15 to 40% and Ni: 40 to 80%, P and S exert the most malign influence on the liquation crack in the HAZ. Also, S exerts the most malign influence on the brittle crack in the HAZ, followed by the malign influences of P and Sn.

In order to prevent both of the above-mentioned two cracks, it is necessary that the value of the parameter P1, mentioned hereinabove, should be not more than 0.05 and that this parameter P1, in relation to the parameter P2, should satisfy the condition ($P2 \leqq 7.5-10 \times P1$). These requirements will be explained below.

Regarding the value of parameter P1: When the value of P1, defined by the aforementioned formula (1), that is to say, $[S+\{(P+Sn)/2\}+\{(As+Zn+Pb+Sb)/5\}]$, exceeds 0.050, the liquation crack in the HAZ which occurs at the time of welding fabrication and the brittle crack in the HAZ which occurs during the use at high temperatures cannot be prevented.

Therefore, the value of the parameter P1 is defined as satisfying the following formula (3). The value of the parameter P1 is preferably not more than 0.045. It is also preferable that the value of the parameter P1 be reduced as low as possible;

$$P1 \leqq 0.050 \quad (3).$$

Regarding the value of the parameter P2:

The value of P2 expressed by the aforementioned formula (2) of [Ti+2Al] exerts influences on the creep strength, the liquation crack in the HAZ which occurs at the time of welding fabrication, the brittle crack in the HAZ during the use at high temperatures and the defects due to welding fabricability.

That is to say, as described above, Ti and Al, which construct the parameter P2, form a fine intragranular intermetallic compound together with Ni; and thus they have a function of enhancing the creep strength at high temperatures.

However, when the contents of Ti and Al become excessive, the segregations thereof, which are caused by the welding thermal cycle at the time of welding fabrication, occur at the grain boundaries; and the said segregations of Ti and Al lower the melting point of the grain boundary together with the segregations of the aforementioned impurity elements form P to Sb, and thus the susceptibility to the liquation crack in the HAZ increases. Also, when the contents of Ti and Al become excessive, a large amount of fine intragranular precipitates, which are formed during the use at high temperatures, hinder the intragranular deformation and therefore stress concentration occurs at the interface of the embrittled grain boundaries where the said segregations of the impurity elements occurred. Thus the brittle crack in the HAZ is promoted. Moreover, since Ti and Al have high affinity with N and easily form nitrides. Therefore, if Ti and Al are consumed to form nitrides, they cannot form fine intragranular intermetallic compounds.

Consequently, in order to suppress the formation of nitrides of Ti and Al, and moreover, in order to ensure the excellent creep strength due to the fine intragranular intermetallic compounds of Ti and Al, it is necessary that the value of the parameter P2 should be not less than 0.2%, and that the value of $(0.002 \times P2+0.019)$ should be not less than the content of N.

On the other hand, as described above, when the contents of Ti and Al become excessive, and the value of the parameter P2 increases, the susceptibilities to both of the liquation crack in the HAZ and the brittle crack in the HAZ increase, and in particular, in relation to the aforementioned parameter P1, the value of the parameter P2 exceeds $(7.5-10 \times P1)$, the above-mentioned two cracks cannot be suppressed.

Moreover, Ti and Al are strong deoxidizing elements. Therefore, a part of base metal is fused during welding fabrication, and then mixes in the weld metal, and combines with O to form weld slag, so that the compatibility with weld metal of subsequent welding fabrication deteriorates; it results in the defects due to welding fabricability such as a non-uniformity of bead, a lack of fusion and the like. These defects, due to welding fabricability, can be prevented by setting the value of the parameter P2 to not more than $(9.0-100 \times O)$ in relation to the content of O.

Therefore, the value of the parameter P2 is defined as satisfying the following formulas (4) to (6) in relation to the value of P1, the content of O and the content of N;

$$0.2 \leqq P2 \leqq 7.5-10 \times P1 \quad (4),$$

$$P2 \leqq 9.0-100 \times O \quad (5), \text{ and}$$

$$N \leqq 0.002 \times P2+0.019 \quad (6).$$

One austenitic heat resistant alloy of the present invention comprises the above-mentioned elements with the balance being Fe and impurities. As already described, the term "impurities" in "Fe and impurities" as the balance means substances, that are mixed in by various factors of the manufacturing process, when the heat resistant alloy is manufactured in an industrial manner, including a raw material such as ore, scrap and so on.

Another austenitic heat resistant alloy of the present invention can further selectively contain, according to need, Co: not more than 20% in lieu of a part of Fe.

Also, still another austenitic heat resistant alloy of the present invention can further selectively contain, according to need, one or more elements of each of the following groups of elements in lieu of a part of Fe;

First group: B: not more than 0.01%;

Second group: Ta: not more than 0.1%, Hf: not more than 0.1%, Nb: not more than 0.1% and Zr: not more than 0.2%; and Third group: Ca: not more than 0.02%, Mg: not more than 0.02%, y: not more than 0.1%, La: not more than 0.1%, Ce: not more than 0.1% and Nd: not more than 0.1%.

The aforementioned optional elements will be explained below.

Co: not more than 20%

Like Ni, Co (cobalt) is an austenite-forming element; it increases the stability of the austenitic phase and makes a contribution to the enhancement of creep strength. Therefore Co may be added to the alloys in order to achieve such an effect. However, Co is a very expensive element, and, therefore, an increased content thereof results in an increase in cost. In particular, when the content of Co exceeds 20%, the cost remarkably increases. Therefore, if Co is added, the content of Co is set to not more than 20%. The upper limit of the Co content is preferably set to 15% and more preferably set to 13%. On the other hand, in order to surely achieve the aforementioned effect of the Co, the lower limit of the Co content is preferably set to 0.03% and more preferably set to 0.5%.

B: not more than 0.01%

B (boron), which is the element of the first group, segregates on the grain boundaries and also disperses carbides precipitating finely on the grain boundaries, thus makes a contribution to the strengthening of the grain boundaries. Therefore, in order to enhance both the high temperature strength and the creep rupture strength, B may be added to the alloys. However, an excessive addition of B lowers the melting point of the grain boundary; in particular, when the content of B exceeds 0.01%, the decrease of the melting point of grain boundary becomes remarkable, and therefore, the liquation crack in the HAZ occurs during welding fabrication. Therefore, if B is added, the content of B is set to not more than 0.01%. The preferable upper limit of the B content is 0.008%. On the other hand, in order to surely achieve the aforementioned effect of the B, the lower limit of the B content is preferably set to 0.0001% and more preferably set to 0.0005%.

Each of Ta, Hf, Nb and Zr being elements of the second group, has the effect of enhancing the high temperature strength. Therefore, in order to obtain this effect, the said elements may be added to the alloys. The elements, which are in the second group, are now explained in detail.

Ta: not more than 0.1%, Hf: not more than 0.1%, Nb: not more than 0.1%

Ta (tantalum), Hf (hafnium) and Nb (niobium) dissolve into the austenitic phase, which is a matrix, or they precipitate as carbides. They are elements which make a contribution to the enhancement of high temperature strength, and therefore, in order to obtain this effect, the above-mentioned elements may be added to the alloys. However, if these elements are added excessively, the amount of precipitation of the carbides increases, and in particular, for any of these elements, when their content exceeds 0.1%, a large amount of carbides precipitate and thereby toughness deteriorates. Therefore, if Ta, Hf and Nb are added, the content of any of Ta, Hf and Nb is set to not more than 0.1%. The preferable upper limit of the content of any of these elements is 0.08%. On the other hand, in order to surely obtain the aforementioned effect of the Ta, Hf and Nb, the lower limit of the content of any of these elements is preferably set to 0.002% and more preferably set to 0.005%.

Zr: not more than 0.2%

Zr (zirconium) dissolves into the austenitic phase, which is a matrix; it is an element which makes a contribution to the enhancement of high temperature strength, and therefore, in order to obtain this effect, Zr may be added to the alloys. However, if the content of Zr increases and exceeds 0.2%, the creep ductility deteriorates, and in addition, the susceptibility to the brittle crack in the HAZ during the long-term of use increases. Therefore, if Zr is added, the content of Zr is set to not more than 0.2%. The preferable upper limit of the Zr content is 0.15%. On the other hand, in order to surely obtain the aforementioned effect of Zr, the lower limit of Zr content is preferably set to 0.005 and more preferably set to 0.01%.

Each of Ca, Mg, Y, La, Ce and Nd being elements of the third group, has the effect of increasing the hot workability. Each of them also has the effect of reducing the brittle crack in the HAZ which is caused by the segregation of S on the grain boundaries. Therefore, in order to obtain these effects, the said elements may be added to the alloys. The elements, which are in the third group, are now explained in detail.

Ca: not more than 0.02% and Mg: not more than 0.02%

Each of Ca (calcium) and Mg (magnesium) has an effect of improving the hot workability. They are also effective, although to a slight extent, in reducing the liquation crack in the HAZ and the brittle crack in the HAZ which are caused by the segregation of S on the grain boundaries. Therefore, in order to obtain these effects, the above-mentioned elements may be added to the alloys. However, excessive additions of these elements cause deterioration of the cleanliness of the alloy, due to the binding thereof to oxygen; in particular, for either of these elements, when the content thereof exceeds 0.02%, the deterioration of the cleanliness of the alloy remarkably increases and the hot workability deteriorates inversely. Therefore, if they are added, the content of each of Ca and Mg is set to not more than 0.02%. The preferable upper limit of the content of each of these elements is 0.015%. On the other hand, in order to surely achieve the aforementioned effects of Ca and Mg, the lower limit of the content of each of these elements is preferably set to 0.0001% and more preferably set to 0.0005%.

Y: not more than 0.1%, La: not more than 0.1%, Ce: not more than 0.1% and Nd: not more than 0.1%

Each of Y (yttrium), La (lanthanum), Ce (cerium) and Nd (neodymium) has an effect of increasing the hot workability and also has an effect of reducing the brittle crack in the HAZ due to the segregation of S on the grain boundaries. Therefore, in order to obtain these effects, the aforementioned elements may be added to the alloys. However, excessive additions of these elements cause deterioration of the cleanliness of the alloy, due to the binding thereof to 0; in particular, for any of these elements, when the content thereof exceeds 0.1%, the deterioration of the cleanliness of the alloy remarkably increases and the hot workability deteriorates inversely. Therefore, if they are added, the content of each of Y, La, Ce and Nd is set to not more than 0.1%. The preferable upper limit of the content of each of these elements is 0.08%. On the other hand, in order to surely obtain the aforementioned effects of the Y, La, Ce and Nd, the lower limit of the content of each of these elements is preferably set to 0.001% and more preferably set to 0.005%.

The austenitic heat resistant alloys of the present invention can be produced, for example, by selecting the raw materials to be used in the melting step based on the results of careful and detailed analyses so that, in particular, the contents of P, S, Sn As, Zn, Pb and Sb among the impurities are P: not more than 0.04%, S: not more than 0.03%, Sn: not more than 0.1%, As: not more than 0.01%, Zn: not more than 0.01%, Pb: not more than 0.01% and Sb: not more than 0.01%, and moreover the value of P1 defined by the said formula (1) and the value of P2 defined by the said formula (2) satisfy the relationships expressed by the following formulas (3) and (4), and then melting the said raw material using an electric furnace, an AOD furnace, a VOD furnace and the like so that the relationship expressed by the following formulas (5) and (6) are satisfied by controlling the contents of O and N;

$$P1 \leqq 0.050 \quad (3),$$

$$0.2 \leqq P2 \leqq 7.5 - 10 \times P1 \quad (4),$$

$$P2 \leqq 9.0 - 100 \times O \quad (5),$$

$$N \leqq 0.002 \times P2 + 0.019 \quad (6).$$

The following examples illustrate the present invention more specifically. These examples are, however, by no means limited to the scope of the present invention.

EXAMPLES

Austenitic alloys A1 to A11 and B1 to B7 having the chemical compositions shown in Tables 1 and 2 were melted by using a vacuum melting furnace and cast to form 50 kg ingots.

The alloys A1 to A11 shown in Tables 1 and 2 are alloys whose chemical compositions fall within the range regulated by the present invention. On the other hand, the alloys B1 to B7 are alloys whose chemical compositions are out of the range regulated by the present invention.

TABLE 1

| | Chemical composition (% by mass) The balance: Fe and impurities | | | | | | | | | | | | | | | | |
|---|---|---|---|---|---|---|---|---|---|---|---|---|---|---|---|---|---|
| Alloy | C | Si | Mn | Ni | Cr | W | Mo | W + Mo | Ti | Al | N | O | P | S | Sn | As | Zn |
| A1 | 0.08 | 0.17 | 1.02 | 49.8 | 29.8 | 4.0 | — | 4.0 | 0.81 | 0.10 | 0.008 | 0.007 | 0.0110 | 0.0010 | 0.0010 | — | — |
| A2 | 0.08 | 0.17 | 1.01 | 46.9 | 29.8 | 4.1 | 0.1 | 4.2 | 0.51 | 0.12 | 0.007 | 0.005 | 0.0120 | 0.0010 | 0.0010 | 0.0010 | 0.0004 |
| A3 | 0.08 | 0.16 | 1.02 | 49.9 | 29.9 | 7.8 | — | 7.8 | 0.82 | 0.20 | 0.008 | 0.012 | 0.0150 | 0.0010 | 0.0050 | 0.0020 | 0.0020 |
| A4 | 0.07 | 0.18 | 1.05 | 49.7 | 29.6 | 7.5 | — | 7.5 | 0.81 | 0.42 | 0.008 | 0.009 | 0.0120 | 0.0010 | — | 0.0020 | 0.0010 |
| A5 | 0.06 | 0.08 | 0.21 | 54.6 | 21.7 | 5.6 | 5.5 | 11.1 | 0.98 | 0.99 | 0.008 | 0.015 | 0.0090 | 0.0010 | 0.0030 | 0.0010 | 0.0010 |

TABLE 1-continued

| Alloy | Chemical composition (% by mass) The balance: Fe and impurities | | | | | | | | | | | | | | | | |
|---|---|---|---|---|---|---|---|---|---|---|---|---|---|---|---|---|---|
| | C | Si | Mn | Ni | Cr | W | Mo | W + Mo | Ti | Al | N | O | P | S | Sn | As | Zn |
| A6 | 0.06 | 0.05 | 0.21 | 53.7 | 22.2 | 5.6 | 5.6 | 11.2 | 1.05 | 1.01 | 0.007 | 0.010 | 0.0110 | 0.0010 | 0.0010 | — | — |
| A7 | 0.06 | 0.05 | 0.21 | 54.3 | 22.2 | 5.5 | 5.5 | 11.0 | 1.05 | 1.03 | 0.007 | 0.008 | 0.0100 | 0.0010 | 0.0010 | — | 0.0010 |
| A8 | 0.06 | 0.07 | 0.22 | 53.3 | 22.4 | 5.5 | 5.5 | 11.0 | 1.21 | 1.40 | 0.008 | 0.014 | 0.0120 | 0.0010 | 0.0030 | 0.0010 | — |
| A9 | 0.06 | 0.08 | 0.23 | 63.2 | 22.2 | 5.5 | 5.3 | 10.8 | 1.19 | 1.35 | 0.008 | 0.008 | 0.0120 | 0.0010 | — | — | 0.0010 |
| A10 | 0.06 | 0.05 | 0.22 | 63.6 | 22.1 | 5.5 | 5.4 | 10.9 | 1.24 | 1.40 | 0.007 | 0.010 | 0.0110 | 0.0010 | 0.0010 | 0.0010 | — |
| A11 | 0.07 | 0.07 | 0.20 | 51.1 | 22.5 | 5.8 | 5.1 | 10.9 | 2.10 | 2.20 | 0.006 | 0.012 | 0.0180 | 0.0030 | 0.0050 | 0.0010 | — |
| B1 | 0.08 | 0.17 | 0.99 | 49.5 | 29.5 | 4.5 | — | 4.5 | 0.93 | 0.50 | 0.007 | 0.009 | 0.0280 | 0.0040 | 0.0700 | 0.0010 | 0.0010 |
| B2 | 0.07 | 0.20 | 1.01 | 49.7 | 29.9 | 4.0 | — | 4.0 | 0.05 | 0.05 | 0.007 | 0.014 | 0.0140 | 0.0010 | 0.0040 | 0.0010 | 0.0010 |
| B3 | 0.08 | 0.16 | 1.02 | 49.1 | 30.1 | 4.2 | — | 4.2 | 2.20 | 2.79 | 0.006 | 0.014 | 0.0150 | 0.0020 | 0.0600 | 0.0200 | — |
| B4 | 0.06 | 0.09 | 0.25 | 61.8 | 22.0 | 6.1 | 4.9 | 11.0 | 2.20 | 2.54 | 0.006 | 0.010 | 0.0290 | 0.0050 | 0.0600 | 0.0030 | 0.0020 |
| B5 | 0.08 | 0.09 | 0.19 | 56.3 | 22.5 | 5.0 | 5.1 | 10.1 | 0.10 | 0.02 | 0.008 | 0.006 | 0.0160 | 0.0020 | 0.0060 | 0.0010 | — |
| B6 | 0.07 | 0.08 | 0.22 | 51.4 | 22.0 | 5.3 | 5.5 | 10.8 | 1.96 | 2.80 | 0.007 | 0.015 | 0.0180 | 0.0030 | 0.0300 | 0.0020 | 0.0020 |
| B7 | 0.07 | 0.06 | 0.18 | 54.1 | 22.5 | 5.0 | 5.2 | 10.2 | 0.28 | 0.31 | *0.022 | 0.006 | 0.0110 | 0.0010 | 0.0010 | — | — |

The mark * indicates falling outside the conditions regulated by the present invention.

TABLE 2

(continued from Table 1)

| Alloy | Chemical composition (% by mass) The balance: Fe and impurities | | | | | | | | |
|---|---|---|---|---|---|---|---|---|---|
| | Pb | Sb | Co | B | Others | P1 | P2 | [7.5 · 10 × P1] | [9.0 · 100 × O] | [0.002 × P2 + 0.019] |
| A1 | — | 0.0005 | — | 0.0039 | Nb: 0.01, Ca: 00003 | 0.007 | 1.010 | 7.429 | 8.300 | 0.0210 |
| A2 | 0.0010 | 0.0005 | — | — | — | 0.008 | 0.750 | 7.419 | 8.500 | 0.0205 |
| A3 | 0.0020 | 0.0007 | — | 0.0038 | Zr: 0.02, Nd: 0.002 | 0.012 | 1.220 | 7.377 | 7.800 | 0.0214 |
| A4 | — | 0.0005 | 0.03 | — | Mg: 0.0005, Ta: 0.003 | 0.008 | 1.650 | 7.423 | 8.100 | 0.0223 |
| A5 | 0.0020 | 0.0007 | 9.98 | 0.0039 | Ca: 00002, Zr: 0.04 | 0.008 | 2.960 | 7.421 | 7.500 | 0.0249 |
| A6 | 0.0020 | — | 10.12 | — | — | 0.007 | 3.070 | 7.426 | 8.000 | 0.0251 |
| A7 | — | — | 9.85 | — | Nb: 0.003, Mg: 0.0001 | 0.007 | 3.110 | 7.433 | 8.200 | 0.0252 |
| A8 | — | 0.0005 | 9.90 | 0.0039 | Nd: 0.003 | 0.009 | 4.010 | 7.412 | 7.600 | 0.0270 |
| A9 | — | — | — | 0.0041 | Ta: 0.002 | 0.007 | 3.890 | 7.428 | 8.200 | 0.0268 |
| A10 | — | — | — | — | — | 0.007 | 4.040 | 7.434 | 8.000 | 0.0271 |
| A11 | — | — | 10.31 | — | Ca: 0.0003, Nd: 0.001 | 0.015 | 6.500 | 7.353 | 7.800 | 0.0320 |
| B1 | — | — | — | 0.0058 | — | *0.053 | 1.930 | 6.966 | 8.100 | 0.0229 |
| B2 | — | — | — | 0.0045 | Hf: 0.005 | 0.010 | *0.150 | 7.396 | 7.600 | 0.0193 |
| B3 | 0.0200 | — | — | 0.0062 | Ce: 0.002 | 0.048 | *7.780 | 7.025 | 7.600 | 0.0346 |
| B4 | — | — | 10.10 | 0.0062 | Ta: 0.002 | *0.051 | *7.280 | 6.995 | 8.000 | 0.0336 |
| B5 | 0.0010 | — | 10.20 | — | — | 0.013 | *0.140 | 7.366 | 8.400 | 0.0193 |
| B6 | 0.0050 | — | 10.53 | 0.0058 | — | 0.029 | *7.560 | 7.212 | 7.500 | 0.0341 |
| B7 | 0.0010 | — | 10.05 | — | — | 0.007 | 0.900 | 7.428 | 8.400 | 0.0208 |

P1 = S + {(P + Sn)/2} + {(As + Zn + Pb + Sb)/5}

P2 = Ti + 2Al

The mark * indicates falling outside the conditions regulated by the present invention.

From the thus-obtained ingot, alloy plates with 20 mm in thickness, 50 mm in width and 100 mm in length were manufactured by hot forging, hot rolling, heat treatment and machining. Also, from the identical ingot, complete common-metal welding materials having an outside diameter of 2.4 mm were manufactured by hot forging and hot rolling.

The above alloy plates with 20 mm in thickness, 50 mm in width and 100 mm in length, were machined for providing each of them with a shape of V-groove with a root thickness of 1 mm and an angle of 30° in the longitudinal direction. Then each of them was subjected to four side-restrained welding onto a commercial SM400C steel plate, 25 mm in thickness, 200 mm in width and 200 mm in length, as standardized in JIS G 3106 (2004) using "DNiCrFe-3" specified in JIS Z 3224 (1999) as a covered electrode.

Then, each alloy plate was subjected to two-layer welding in the groove using the said common-metal welding material, which has the same composition as that of the plate material, by the TIG welding under a heat input condition of 9 to 12 kJ/cm. Furthermore, subsequent build-up welding was carried out in the said groove using the welding wire (AWS standard A5.14 "ER NiCrCoMo-1") by the TIG welding under a heat input condition of 12 to 15 kJ/cm.

For the welded joints under the "as welded condition" and the welded joints subjected to an aging heat treatment of 700° C.×500 hours after the said welding, a cross section thereof was mirror-like polished and etched, and thereafter the occurrences of the brittle crack in the HAZ, the liquation crack in the HAZ and the defect due to welding fabricability were examined by using a microscope. Also, the fractured surface of the crack was observed by using a SEM (scanning electron microscope).

The microscopic examination results of the cross section and the observation results of the fractured surface of the crack are shown in Table 3. In the column of "crack evaluation" in Table 3, the symbol "○" indicates that no crack was observed and the symbol "x" indicates that a crack was observed. Similarly, in the column of "defect due to welding fabricability evaluation" in Table 3, the symbol "○" indicates that no defect due to welding fabricability was observed and the symbol "x" indicates that a defect due to welding fabricability was observed.

TABLE 3

| Test No. | Alloy | Crack evaluation as welded | Crack evaluation after aging | Defect due to welding fabricability evaluation | Result of creep rupture test | Note |
|---|---|---|---|---|---|---|
| 1 | A1 | ○ | ○ | ○ | ○ | Inventive Example |
| 2 | A2 | ○ | ○ | ○ | ○ | |
| 3 | A3 | ○ | ○ | ○ | ○ | |
| 4 | A4 | ○ | ○ | ○ | ○ | |
| 5 | A5 | ○ | ○ | ○ | ○ | |
| 6 | A6 | ○ | ○ | ○ | ○ | |
| 7 | A7 | ○ | ○ | ○ | ○ | |
| 8 | A8 | ○ | ○ | ○ | ○ | |
| 9 | A9 | ○ | ○ | ○ | ○ | |
| 10 | A10 | ○ | ○ | ○ | ○ | |
| 11 | A11 | ○ | ○ | ○ | ○ | |
| 12 | *B1 | x | x | ○ | — | Comparative Example |
| 13 | *B2 | ○ | ○ | ○ | x | |
| 14 | *B3 | ○ | ○ | x | — | |
| 15 | *B4 | x | x | ○ | — | |
| 16 | *B5 | ○ | ○ | ○ | x | |
| 17 | *B6 | ○ | x | x | — | |
| 18 | *B7 | ○ | ○ | ○ | x | |

The mark * indicates falling outside the conditions regulated by the present invention.

In the column of "Crack evaluation" the symbol "○" indicates that no crack was observed and the symbol "x" indicates that a crack was observed.

In the column of "Defect due to welding fabricability evaluation" the symbol "○" indicates that no defect due to welding fabricability was observed, and the symbol "x" indicates that a defect due to welding fabricability was observed.

In the column of "Result of creep rupture test" the symbol "○" indicates that the rupture time reached the desired time, the symbol "x" indicates that the rupture time did not reach the desired time and the symbol "—" denotes that the creep rupture test was not carried out.

As shown in Table 3, as the result of the microscopic examination of the cross section, in each Test Nos. 12, 15 and 17 in which the alloys B1, B4 and B6 were respectively used, a crack was observed on the cross section.

In the case of Test No. 12 where the alloy B1 was used, the result of the observation of the fractured surface of the crack revealed that only the fractured surface, on which the fusion trace was noticed, existed in both the welded joint under the "as welded condition" and the welded joint subjected to the said aging heat treatment. Therefore, this crack is a "liquation crack in the HAZ" which occurred at the time of welding fabrication, and the said "liquation crack in the HAZ" was also observed after the aging heat treatment.

In the case of Test No. 17 where the alloy B6 was used, the fractured surface with poor ductility was observed only in the welded joint subjected to the said aging heat treatment. This crack is a "brittle crack in the HAZ" due to the aging treatment at a high temperature.

On the other hand, in the case of Test No. 15 where the alloy B4 was used, the fractured surface, on which the fusion trace was noticed, was observed in the welded joint under the "as welded condition"; the fractured surface, on which the fusion trace was noticed, was observed together with the fractured surface with poor ductility in the welded joint subjected to the said aging heat treatment. Therefore, it can be seen in this Test No. 15 that both the "liquation crack in the HAZ" and the "brittle crack in the HAZ" occurred.

In the cases of Test No. 14, in which the alloy B3 was used, and in the case of Test No. 17, in which the alloy 86 was used, the defect due to welding fabricability, namely the lack of fusion, occurred in the vicinity of the primary layer.

On the other hand, in the case of Test Nos. 1 to 11, 13, 16 and 18, no crack was observed on the cross section and no defect due to welding fabricability at the time of welding fabrication was observed.

Next, regarding the Test Nos. 1 to 11, 13, 16 and 18, in which no crack was observed on the cross section and no defect due to welding fabricability at the time of welding fabrication was observed, creep rupture test specimens were prepared from each welded joint under the "as welded condition", and the creep rupture test specimens were subjected to a creep rupture test under the conditions of 700° C. and 176 MPa, which corresponds to a desired rupture time of the base metal, namely not less than 1000 hours.

The results of the above-mentioned creep rupture test are also shown in Table 3. In Table 3, the symbol "○" indicates that the creep rupture time under the aforementioned conditions exceeded 1000 hours, which corresponds to the desired rupture time of the base metal; and the symbol "x" indicates that the said creep rupture time did not reach 1000 hours. The symbol "–" in Test Nos. 12, 14, 15 and 17 denotes that the creep rupture test was not carried out.

As shown in Table 3, in Test Nos. 1 to 11, the rupture time exceeded the desired 1000 hours, but in Test Nos. 13, 16 and 18, the rupture time did not reach 1000 hours.

As is apparent from the above-described test results, only the alloys whose chemical compositions fall within the range regulated by the present invention can prevent defects due to welding fabricability, which occur during welding fabrication; therefore they have excellent welding fabricability; they can prevent the liquation crack in the HAZ at the time of welding fabrication and the brittle crack in the HAZ during the long-term of use at high temperatures, and moreover they have excellent creep strength.

Industrial Applicability

The austenitic heat resistant alloys of the present invention can prevent both the liquation crack in the HAZ and the brittle crack in the HAZ and also can prevent defects due to welding fabricability, which occur during welding fabrication. Moreover, they have excellent creep strength at high temperatures. Therefore, the austenitic heat resistant alloys of the present invention can be used suitably as materials for constructing high temperature machines and equipment, such as power generating boilers, plants for the chemical industry and so on.

What is claimed is:

1. An austenitic heat resistant alloy, which consists of, by mass percent, C: not more than 0.15%, Si: not more than 2%, Mn: not more than 3%, Ni: 40 to 80%, Cr: 15 to 40%, W: not less than 3%, and W and Mo: 3 to 15% in total content, Ti: not more than 3%, Al: not more than 3%, Co: 9.85 to 20%, N: not more than 0.03% and O: not more than 0.03%, with the balance being Fe and impurities, in which the contents of P, S, Sn, As, Zn, Pb and Sb among the impurities are P: not more than 0.04%, S: not more than 0.03%, Sn: not more than 0.1%, As: not more than 0.01%, Zn: not more than 0.01%, Pb: not more than 0.01% and Sb: not more than 0.01%, and the value of P1 defined by the following formula (1) and the value of P2 defined by the following formula (2) satisfy the relationships expressed by the following formulas (3) to (6);

$$P1=S+\{(P+Sn)/2\}+\{(As+Zn+Pb+Sb)/5\} \quad (1),$$

$$P2=Ti+2Al \quad (2),$$

$$P1\leqq 0.050 \quad (3),$$

$$0.2\leqq P2\leqq 7.5-10\times P1 \quad (4),$$

$$P2\leqq 9.0-100\times O \quad (5),$$

$$N\leqq 0.002\times P2+0.019 \quad (6);$$

wherein each element symbol in the formulas represents the content by mass percent of the element concerned.

2. An austenitic heat resistant alloy, which consists of, by mass percent, C: not more than 0.15%, Si: not more than 2%, Mn: not more than 3%, Ni: 40 to 80%, Cr: 15 to 40%, W: not less than 3%, and W and Mo: 3 to 15% in total content, Ti: not more than 3%, Al: not more than 3%, Co: 9.85 to 20%, N: not more than 0.03% and O: not more than 0.03%, and one or more elements of one or more groups selected from the first to third groups listed below, with the balance being Fe and impurities, in which the contents of P, S, Sn, As, Zn, Pb and Sb among the impurities are P: not more than 0.04%, S: not more than 0.03%, Sn: not more than 0.1%, As: not more than 0.01%, Zn: not more than 0.01%, Pb: not more than 0.01% and Sb: not more than 0.01%, and the value of P1 defined by the following formula (1) and the value of P2 defined by the following formula (2) satisfy the relationships expressed by the following formulas (3) to (6);

$$P1=S+\{(P+Sn)/2\}+\{(As+Zn+Pb+Sb)/5\} \quad (1),$$

$$P2=Ti+2Al \quad (2),$$

$$P1\leqq 0.050 \quad (3),$$

$$0.2\leqq P2\leqq 7.5-10\times P1 \quad (4),$$

$$P2\leqq 9.0-100\times O \quad (5),$$

$$N\leqq 0.002\times P2+0.019 \quad (6);$$

wherein each element symbol in the formulas represents the content by mass percent of the element concerned;

first group: B: not more than 0.01%;

second group: Ta: not more than 0.1%, Hf: not more than 0.1%, Nb: not more than 0.1% and Zr: not more than 0.2%; and third group: Ca: not more than 0.02%, Mg: not more than 0.02%, Y: not more than 0.1%, La: not more than 0.1%, Ce: not more than 0.1% and Nd: not more than 0.1%.

* * * * *